US008019266B2

(12) United States Patent
Baba et al.

(10) Patent No.: US 8,019,266 B2
(45) **Date of Patent: *Sep. 13, 2011**

(54) FIXING DEVICE AND IMAGE FORMING DEVICE

(75) Inventors: Motofumi Baba, Kanagawa (JP); Yasuhiro Uehara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/943,750

(22) Filed: Nov. 21, 2007

(65) Prior Publication Data

US 2008/0124111 A1 May 29, 2008

(30) Foreign Application Priority Data

Nov. 24, 2006 (JP) ..... 2006-317243
Nov. 21, 2007 (JP) ..... 2007-301146

(51) Int. Cl.
*G03G 15/20* (2006.01)

(52) U.S. Cl. ..... 399/333; 399/330; 399/69

(58) Field of Classification Search ..... 399/67, 399/69, 328–330, 333; 219/216, 619; 347/156
See application file for complete search history.

(56) References Cited

U.S. PATENT DOCUMENTS 6,021,303 A 2/2000 Terada et al. ..... 399/328
RE38,810 E * 10/2005 Terada et al. ..... 399/328
7,194,234 B2 * 3/2007 Katakabe et al. ..... 399/330
7,329,845 B2 * 2/2008 Kagawa ..... 219/619
7,466,950 B2 * 12/2008 Matsuura et al. ..... 399/328
2006/0216080 A1 9/2006 Nanjo ..... 399/333
2008/0063445 A1 * 3/2008 Imai et al. ..... 399/333

FOREIGN PATENT DOCUMENTS

JP 2001-176648 6/2001
JP 3527442 2/2004
JP 2005-148350 6/2005
JP 2005-208624 8/2005
JP 2006-071960 3/2006

* cited by examiner

*Primary Examiner* — Thomas M Sember
(74) *Attorney, Agent, or Firm* — Morgan, Lewis & Bockius LLP

(57) ABSTRACT

The invention provides a fixing device having at least: a first rotary body, having a heat generating layer from which heat is generated by action of a magnetic field: a second rotary body contacting the first rotary body; a magnetic field generating unit arranged to have a predetermined separation from the inner circumferential face of the first rotary body or to have a predetermined separation from the outer circumferential face of the first rotary body; and a heat generation controlling member arranged facing the magnetic field generating unit, with the first rotary body being between the heat generation controlling member and the magnetic field generating unit, the heat generation controlling member having at least a temperature-sensitive magnetic material having a Curie temperature and controlling generation of heat of the heat generating layer. The invention further provides an image forming device having at least the mixing device.

19 Claims, 9 Drawing Sheets

FIXING DEVICE AND IMAGE FORMING DEVICE

CROSS-REFERENCE TO RELATED APPLICATION

This application is based on and claims priority under 35 USC 119 from Japanese Patent Applications Nos. 2006-317243 filed on Nov. 24, 2006 and 2007-301146 filed on Nov. 21, 2007.

BACKGROUND

1. Technical Field

The present invention relates to a fixing device, and an image forming device.

2. Related Art

There has been proposed a fixing device for image forming devices in which an electromagnetic induction heating mode is adopted.

SUMMARY

The invention provides a fixing device making it possible to restrain the temperature of regions other than regions that sheets pass by (sheet-passing regions) from rising excessively even if recording media having various sizes are used. The invention further provides an image forming device having a fixing device.

Namely, a first embodiment of a first aspect of the invention is a fixing device comprising:

a first rotary body, having a heat generating layer from which heat is generated by action of a magnetic field and formed in a substantially circular cylindrical shape:

a second rotary body contacting the first rotary body;

a magnetic field generating unit for generating a magnetic field, the magnetic field generating unit being arranged to have a predetermined separation from the inner circumferential face of the first rotary body or to have a predetermined separation from the outer circumferential face of the first rotary body; and a heat generation controlling member which is arranged facing the magnetic field generating unit, with the first rotary body being between the heat generation controlling member and the magnetic field generating unit, the heat generation controlling member comprising a temperature-sensitive magnetic material having a Curie temperature and controlling generation of heat of the heat generating layer.

Further, a second aspect of the invention is an image forming device comprising:

a latent image holding body;

a latent image forming unit for forming a latent image on a surface of the latent image holding body;

a developing unit for developing the latent image into an image with an electrophotographic developer;

a transferring unit for transferring the developed image onto a transfer-receiving medium; and a fixing device of the first aspect of the invention for fixing the image on the transfer-receiving medium.

The first embodiment of the first aspect of the invention provides an advantageous effect of enabling, in comparison to other configurations which lack the characteristics of this embodiment, restraint of the temperature of regions that sheets do not pass by in the first rotary body from rising excessively, even if recording media having various sizes are used.

The second embodiment of the first aspect of the invention provides an advantageous effect of enabling, in comparison to other configurations which lack the characteristics of this embodiment, curbing of bad fixation and deterioration of the first rotary body and curbing of overheating when fixing images.

The third embodiment of the first aspect of the invention provides an advantageous effect of enabling, in comparison to other configurations which lack the characteristics of this embodiment, suppression of a rise in the temperature of the first rotary body in a region through which magnetic flux (a magnetic field) of the heat generation controlling member penetrates.

The fourth embodiment of the first aspect of the invention provides an advantageous effect of enabling, in comparison to other configurations which lack the characteristics of this embodiment, the amount of heat energy transferred in the direction of an axis of the fixing belt per unit time is promoted so as to diffuse the heat energy in the direction of the axis, so that the temperature of regions other than sheet-passing regions is prevented from rising excessively.

The fifth embodiment of the first aspect of the invention provides an advantageous effect of enabling, in comparison to other configurations which lack the characteristics of this embodiment, a sufficient heat can be generated even if the heat generating layer is thin, so that a heat generating layer having a small heat capacity can be obtained.

The sixth embodiment of the first aspect of the invention provides an advantageous effect of enabling, in comparison to other configurations which lack the characteristics of this embodiment, suppression of the self-heating of the heat generation controlling member can be achieved.

The seventh embodiment of the first aspect of the invention provides an advantageous effect of enabling, in comparison to other configurations which lack the characteristics of this embodiment, suppression of the self-heating of the heat generation controlling member and suppression of the transfer of heat energy in the direction of an axis of the heat generation controlling member can be achieved.

The eighth embodiment of the first aspect of the invention provides an advantageous effect of enabling, in comparison to other configurations which lack the characteristics of this embodiment, the suppression of fluctuations in the rotational speed of the first rotary body due to an effect of the sliding resistance of the first rotary body, so that paper wrinkles or unevenness in fixing may be suppressed.

The ninth embodiment of the first aspect of the invention provides an advantageous effect of enabling, in comparison to other configurations which lack the characteristics of this embodiment, more sensitive control of electromagnetic induced heating of a heat generating layer by a heat generation controlling member.

The tenth embodiment of the first aspect of the invention provides an advantageous effect of enabling, in comparison to other configurations which lack the characteristics of this embodiment, suppression of the sliding resistance of the first rotary body so a reduction in lifetime due to abrasion does not readily occur.

The eleventh embodiment of the first aspect of the invention provides an advantageous effect of enabling, in comparison to other configurations which lack the characteristics of this embodiment, suppression a lowering of the speed temperature rise at the starting of the driving of the fixing device due to the lack of a portion which directly contacts with the first rotary body, thus the fixing device is able to reach a fixable state more quickly.

The twelfth embodiment of the first aspect of the invention provides an advantageous effect of enabling, in comparison to other configurations which lack the characteristics of this embodiment, suppression of the self-heating of a heat generation controlling member; accordingly, enabling more sensitive control in reaction to temperature variations of the first rotary body.

The tenth embodiment of the first aspect of the invention provides an advantageous effect of enabling, in comparison to other configurations which lack the characteristics of this embodiment, a heat capacity of the heat generation controlling member to be made smaller; accordingly, the temperature tracking of the heat generation controlling member to temperature variations of the first rotary body is increased, enabling more sensitive responsive temperature control.

The eleventh embodiment of the first aspect of the invention provides an advantageous effect of enabling, in comparison to other configurations which lack the characteristics of this embodiment, removal of a paper sheet from the first rotary body to be made more easily.

The second aspect of the invention provides an advantageous effect of enabling, in comparison to other configurations which lack the characteristics of this aspect, stably obtaining high-quality fixed images over a long term, which is different from any case that the present essential requirement is not satisfied.

BRIEF DESCRIPTION OF THE DRAWINGS

FIG. 5 is a schematic structural view illustrating a heat generation controlling member in the fixing device according to still another embodiment of the present invention, in which the heat generation controlling member is provided with slits.

DETAILED DESCRIPTION

Exemplary embodiments according to the invention will be described hereinafter with reference to the attached drawings. In all of the figures, the same reference numbers are attached to members having substantially the same function, and repeated description thereof may be omitted.

Figure 1:
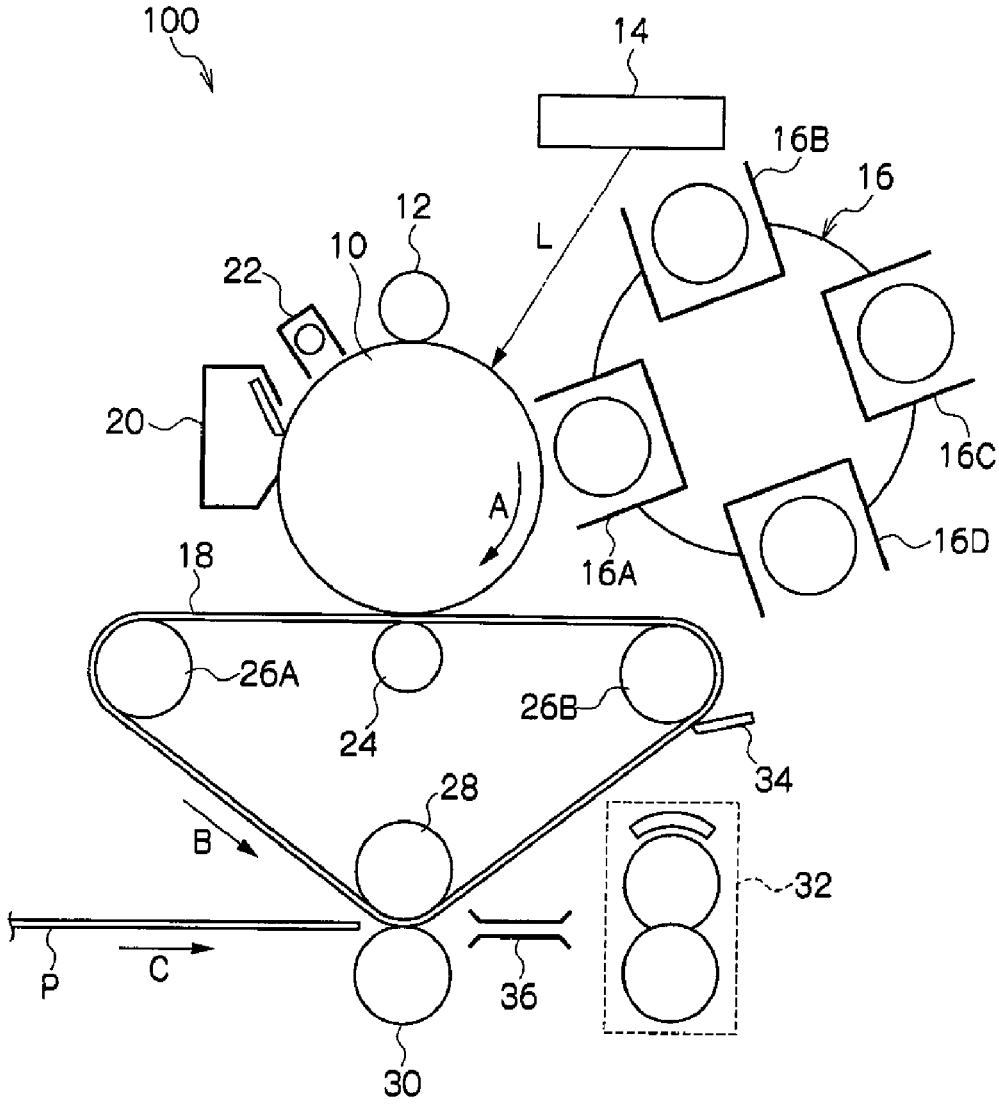
FIG. 1 is a schematic structural view illustrating an image forming device according to an embodiment of the present invention.
Figure 2:
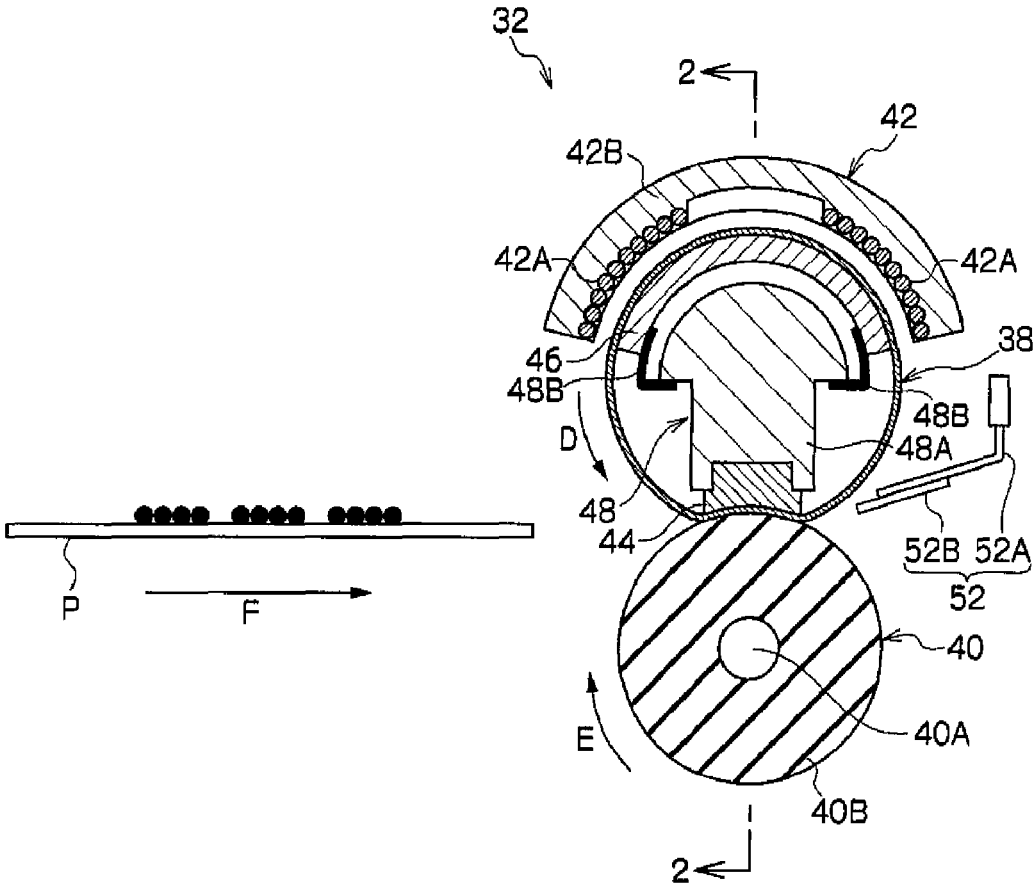
FIG. 2 is a schematic sectional view illustrating a fixing device according to the embodiment of the present invention.
Figure 3:
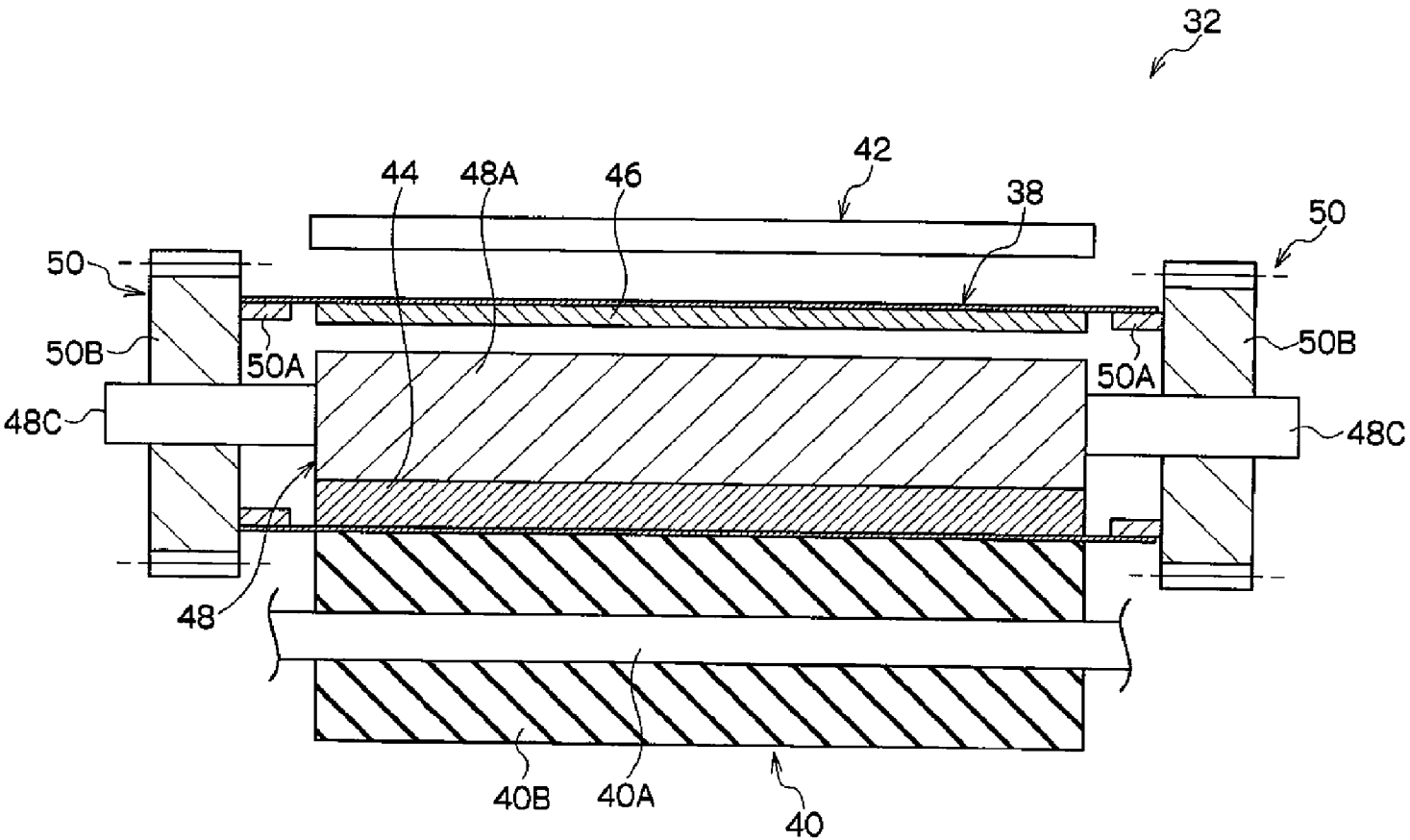
FIG. 3 is a schematic sectional view illustrating the fixing device according to the embodiment of the present invention.

FIG. 1 is a schematic structural view illustrating an image forming device according to an exemplary embodiment. FIG. 2 is a schematic sectional view illustrating a fixing device according to the exemplary embodiment. FIG. 3 is another schematic sectional view illustrating the fixing device according to the exemplary embodiment. FIG. 2 illustrates a cross section viewed along the axial direction of the fixing device, and FIG. 3 illustrates a cross section taken on line 2-2 in FIG. 2 and viewed along a direction perpendicular to the axial direction of the fixing device.

As illustrated in FIG. 1, an image forming device 100, which is the image forming device according to the present exemplary embodiment, has a cylindrical photoreceptor drum 10 rotatable into a single direction (a direction of an arrow A in FIG. 1). Around this photoreceptor drum 10, the following are successively arranged from an upstream side of the drum 10 in the rotating direction thereof toward a downstream side thereof: an charging device 12 for charging the surface of the photoreceptor drum 10; an exposure device 14 for radiating light L imagewise onto the photoreceptor drum 10 to form a latent image on the surface; a developing device 16 for transferring a toner selectively onto the surface of the photoreceptor drum 10 to form a toner image, this device being composed of developing units 16A to 16D; an intermediate transferring body 18, in an endless belt form, which is supported oppositely to the photoreceptor drum 10 and has a rotatable circumferential face; a cleaning device 20 for removing the toner remaining on the photoreceptor drum 10 after the toner image is transferred; and a discharging exposure device 22 for discharging the surface of the photoreceptor drum 10.

Furthermore, inside the intermediate transferring body 18 are arranged a transferring device 24 for transferring the toner image formed on the surface of the photoreceptor drum 10 primarily onto the intermediate transferring body 18, two supporting rolls 26A and 26B, and a transferring opposite roll 28 for attaining secondary transfer. By these members, the intermediate transferring body 18 is strained so as to be rotatable into a single direction (a direction of an arrow B in FIG. 1). At a position opposite to the transferring opposite roll 28, a transferring roll 30 is arranged with the intermediate transferring body 18 interposed between the rolls 28 and 30. The transferring roll 30 is a roll for transferring, onto a recording paper (recording medium) P secondarily, the toner image primarily transferred on the outer circumferential face of the intermediate transferring body 18. The recording paper P is fed to a portion in a direction of an arrow C where the transferring opposite roll 28 and the transferring roll 30 contact each other so as to be pressed against each other. In this press-contact portion, the recording paper P on the surface of which the toner image is secondarily transferred is carried, as it is, in a direction indicated by an arrow C.

At a downstream position of the carrier direction (the arrow C direction) of the recording paper P, a fixing device 32 is arranged for heating the toner image on the surface of the recording paper P so as to be melted, and then fixing the melted image onto the recording paper P. The recording paper P is fed in the fixing device 32 through the paper-carrying guidance member 36. At a downstream side of the intermediate transferring body 18 along the rotating direction of the body 18 (the arrow B direction), a cleaning device 34 is arranged for removing the toner remaining on the surface of the intermediate transferring body 18.

The following will describe the fixing device according to the present exemplary embodiment.

As illustrated in FIGS. 2 and 3, the fixing device 32 according to the present exemplary embodiment has an endless-belt-form fixing belt 38 (a first rotary body) rotatable in a single direction (a direction of an arrow D), a pressing roll 40 (a second rotary body) rotatable in a single direction (a direction of an arrow E) and contacting the circumferential face of the fixing belt 38 so as to be pressed against the face, and a magnetic field generating device 42 (magnetic field generating unit) arranged oppositely to the outer circumferential face of the fixing belt 38 reverse to the press-contact face of the belt 38, which contacts the pressing roll 40, and separately from the outer circumferential face.

On the inner peripheral side of the fixing belt 38 there are provided: a fastening member 44 that forms a contact portion in combination with a pressing roll 40; a heat generation controlling member 46 that faces a magnetic field generating device 42, with the fixing belt 38 therebetween, and is disposed in contact with an inner periphery surface of the fixing belt 38: and a supporting member 48 that supports the fastening member 44. The heat generation controlling member 46 is supported by the supporting member 48. Drive transmission members 50, for transmitting rotary power in order to rotationally drive the fixing belt 38, are disposed at both ends of the fixing belt 38.

At a downstream side of the contact region between the fixing belt 38 and the pressing roll 40 along the carrier direction of the recording paper P (the direction of an arrow F), a peeling member 52 is set up. The peeling member 52 is composed of a supporting section 52A, an end of which is supported in a fastening manner, and a peelable sheet 52B supported by the section 52A. The peeling member 52 is arranged to cause a front end of the peelable sheet 52B to be near or contact the fixing belt 38.

First, the fixing belt 38 will be described hereinafter. Examples of a fixing belt to be applied as the fixing belt 38 of the present exemplary embodiment include a belt which has a substrate and a heat generating layer and a surface releasing layer which are formed on an outer circumferential face of the substrate.

The substrate can be appropriately selected from those made of a material which has heat resistance and strength to support a thin heat generating layer, and which is penetrated by a magnetic field (magnetic fluxes) but does not generate heat with ease or does not generate any heat by the effect of the magnetic field. Examples of the substrate include the following: a metal belt (made of a nonmagnetic metal, such as nonmagnetic stainless steel, or made of a soft magnetic material or hard magnetic material, such as Fe, Ni, Cr, or an alloy thereof such as Ni—Fe alloy or Ni—Cr—Fe alloy) having a thickness of equal to or approximately 30 to equal to or approximately 200 μm (desirably, equal to or approximately 50 to equal to or approximately 150 μm, more desirably equal to or approximately 100 to equal to or approximately 150 μm); or a resin belt (such as a polyimide belt) having a thickness of equal to or approximately 60 to equal to or approximately 200 μm.

The heat generating layer is made of a material that allows a magnetic field (magnetic flux) to readily penetrate therethrough and can be readily heated by the action of the magnetic field. The heat capacity of the heat generating layer is preferably as small as possible. In the case of using a general purpose power source having a frequency of 20 kHz to 100 kHz which can be produced inexpensively, if the heat generating layer is made to be thinner than 50 μm, electromagnetic induction heating of a non-magnetic metal, which has a lower intrinsic resistivity than a magnetic metal, becomes easier than that of a magnetic metal. Conversely, in a case where the thickness of the heat generating layer is 50 μm or greater, heat generation of a magnetic metal becomes easier than that of a non-magnetic metal.

Since a magnetic metal generally has a high intrinsic resistivity and a relative magnetic permeability of several tens to several thousands, it becomes difficult for an eddy current to flow in the depth of an outer cover of an electric conductor made of a magnetic metal. For example, the intrinsic resistivity of iron, which is a magnetic metal, is $9.71\times10^{-8}$ Ωm, and the intrinsic resistivity of nickel, which is a magnetic metal, is $6.84\times10^{-8}$ Ωm. In contrast, the intrinsic resistivity of silver, which is a non-magnetic metal, is $1.59\times10^{-8}$ Ωm, the intrinsic resistivity of copper, which is a non-magnetic metal, is $1.67\times10^{-8}$ Ωm, the intrinsic resistivity of aluminum, which is a non-magnetic metal, is $2.7\times10^{-8}$ Ωm, and each of these has a small intrinsic resistivity and a relative magnetic permeability of approximately 1. For this reason, when these non-magnetic metals are made thin, heat generation becomes easy. Especially when the non-magnetic metals are made to be 20 μm or less, heat generation becomes easy. Conversely, when the non-magnetic metals are made to be thicker than 20 μm, heat generation becomes difficult, and although an eddy current flows, a heat generation amount due to eddy current loss becomes small because the intrinsic resistivity is small.

Specific examples of a configuration of the heat generating layer include a heat generating layer which has a nonmagnetic metal material having a thickness of approximately 2 μm to approximately 20 μm, and desirable examples thereof include that a nonmagnetic metal material having a thickness of approximately 5 μm to approximately 15 μm and a total heat capacity of its heat generating region of approximately 3 J/K or less). Preferable examples of the nonmagnetic metal material include copper, aluminum and silver as described above.

Examples of the surface releasing layer include a fluorine-containing resin layer (such as a PFA layer, which is a layer made of a copolymer made of tetrafluoroethylene and perfluoroalkyl vinyl ether) having a thickness of approximately 1 μm to approximately 30 μm.

The configuration of the fixing belt 38 is not restricted to that described above. Examples of the configuration of the fixing belt 38 further include a belt having a heat generating layer interposed between two substrates, specific examples of which include a belt having a heat generating layer (such as a heat generating layer made of copper) interposed between two stainless steel layers. An elastic layer including silicone rubber, fluorine rubber, fluorosilicone rubber or the like may be further disposed between the substrate and the heat generating layer, or between the heat generating layer and a surface releasing layer.

The fixing belt 38 preferably has a structure having a small heat capacity (for example, a thermal capacity of equal to or approximately 5 to equal to or approximately 60 J/k, desirably equal to or approximately 30 J/K or less) by, for example, making the thickness thereof small or selecting the constituting material(s) thereof The diameter of the fixing belt 38 may be arbitrarily selected and is typically in the range of from equal to or approximately 20 to equal to or approximately 50 mm. The inner circumferential face of the fixing belt 38 may be further modified by, for example, providing a film which is covered with a fluorine-containing resin and has durability against sliding (such as a film which has durability against sliding and is provided only onto the fastening member 44), by coating a fluorine-containing resin thereonto, or by coating a lubricant (such as a silicone oil) thereonto.

Figure 4:
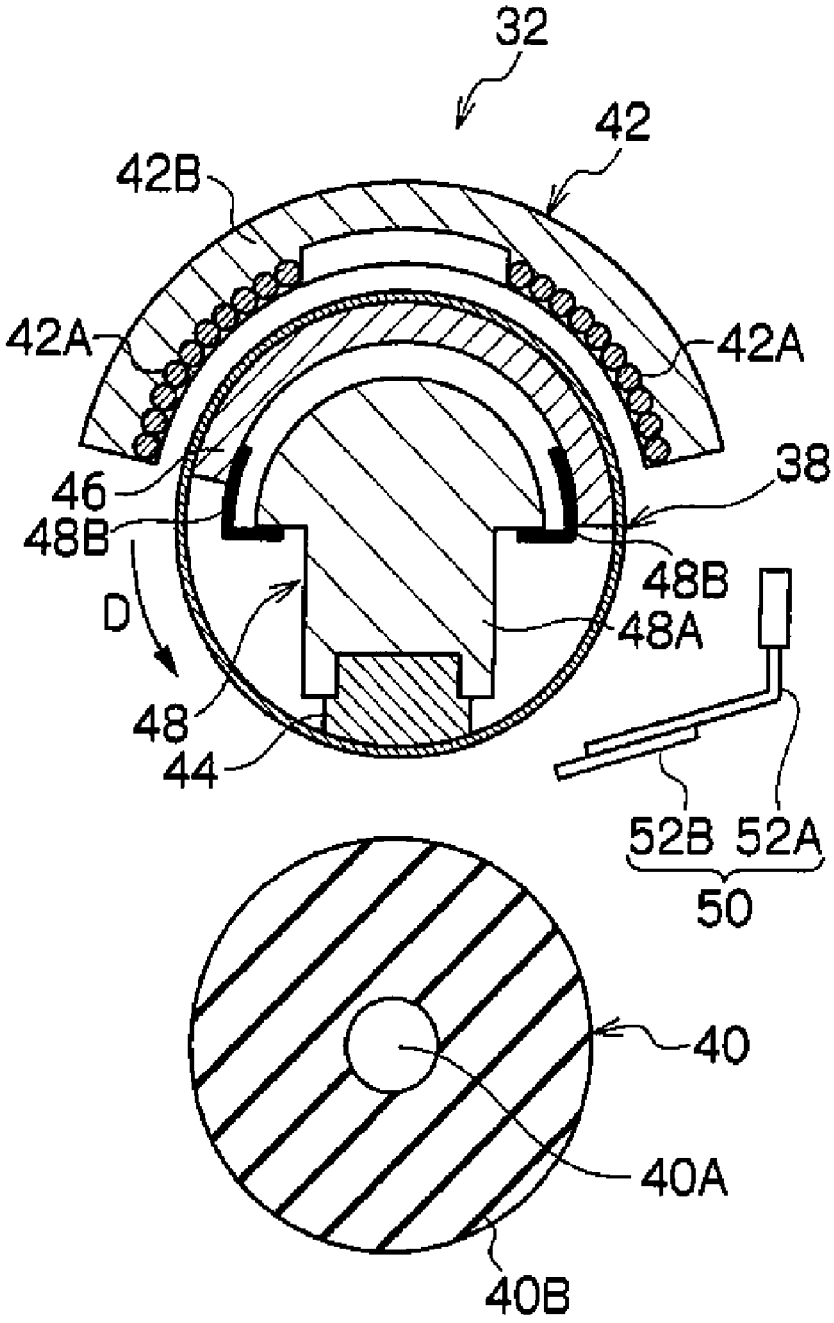
FIG. 4 is a schematic sectional view illustrating a situation that in the fixing device according to the embodiment of the present invention, in which a fixing belt and a pressing roll are separated from each other.

The following will describe the pressing roll 40 hereinafter. While the present exemplary embodiment is a case in which the fixing belt and the pressing roll are separated from each other, the scope of the present invention further includes a case in which the fixing belt and the pressing roll constantly contact with each other. The pressing roll 40 is disposed onto the fastening member 44 at a total load of, e.g., equal to or approximately 294 N (about 30 kgf) by means of spring members (not illustrated in Figures) which presses the pressing roll 40 at both ends of the pressing roll 40 through the fixing belt 38. When the pressing roll 40 is pre-heated (warmed up), the pressing roll 40 is shifted so as to be separated from the fixing belt 38 (see FIG. 4).

The pressing roll 40 may be, for example, a roll having a cylindrical core member 40A made of a metal, and an elastic layer 40B (such as a silicone rubber layer or a fluorine-containing rubber layer) formed on the surface of the core member 40A. If necessary, the pressing roll 40 may further have, on the outermost surface thereof, a surface releasing layer (such as a fluorine-containing resin layer).

The heat generation controlling member 46 will now be described. The heat generation controlling member 46 is formed into a shape that is similar to the shape of the inner periphery surface of the fixing belt 38. The heat generation controlling member 46 thus comes into contact with the inner periphery surface of the fixing belt 38 and is disposed facing the magnetic field generating device 42 through the fixing belt 38.

A heat generation controlling member 46 is disposed to be in contact with the inner periphery surface of the fixing belt 38 without applying a substantial pressing force thereto, while maintaining the fixing belt 38 in a circular cylindrical shape without being contact with a supporting member 48A by use of a spring member 48B of the supporting member 48. In the exemplary embodiment, the heat generation controlling member 46 is in contact with the inner periphery surface of the fixing belt 38 with a force of approximately 1N. Since a tension is not applied to the belt, the belt shape is not varied by an extreme amount even when the heat generation controlling member comes into contact therewith. If a large tension is applied to the fixing belt, the sliding resistance may become higher, and as the result thereof, the lifetime of the belt may be reduced owing to abrasion. When the sliding resistance is increased there is also an increase in the driving torque of the belt, which may cause repeated application of a twisting force on the belt, which may result in problems such as cracking or buckling of the heat generating layer of the belt.

The heat generation controlling member 46 is a temperature controlling member and is composed including a temperature-sensitive magnetic material having a Curie temperature such as a temperature-sensitive magnetic alloy. The Curie temperature of the heat generation controlling member 46 is preferably equal to or higher than a setup temperature of the fixing belt 38, and is preferably equal to or lower than the heat resistant temperature of the fixing belt 38. Specifically, the Curie temperature is desirably from approximately 140° C. to approximately 240° C., and is more desirably from approximately 150° C. to approximately 230° C.

The heat generation controlling member 46 is preferably a "non-heat generating body" which does not generate heat by action of a magnetic field. If the heat generation controlling member 46 has sufficient heat generating capability, the heat generation controlling member 46 may generate heat by electromagnetic induction action when the heat generating layer is heating the fixing belt, and as a result thereof, the heat generation controlling member 46 may generate heat due to eddy current loss and hysteresis loss. If this amount of the generated heat is large, the temperature of the heat generation controlling member 46 may rise and unintentionally reach the Curie temperature thereof, thereby displaying its temperature controlling ability when it is not required. Since the heat generation controlling member 46 is a member necessary for controlling the temperature of the fixing belt, such an unexpected elevation of its temperature due to the self heat generation should be necessarily made as small as possible. The "non-heat generating body" of the present exemplary embodiment is a member having sufficiently small self heat generating ability compared to that of the heat generation of the heat generating layer. When there is a problem in displaying the function of the heat generation controlling member 46 owing to its self heat generating ability, the heat generation controlling member 46 may be configured with slit(s) or cut(s) so that the eddy current loss does not readily occur. The slit or the cut functions as a shielding unit which shields the eddy current generated in the heat generation controlling member 46 by electromagnetic induction action of the magnetic field generating device 42.

Figure 8:
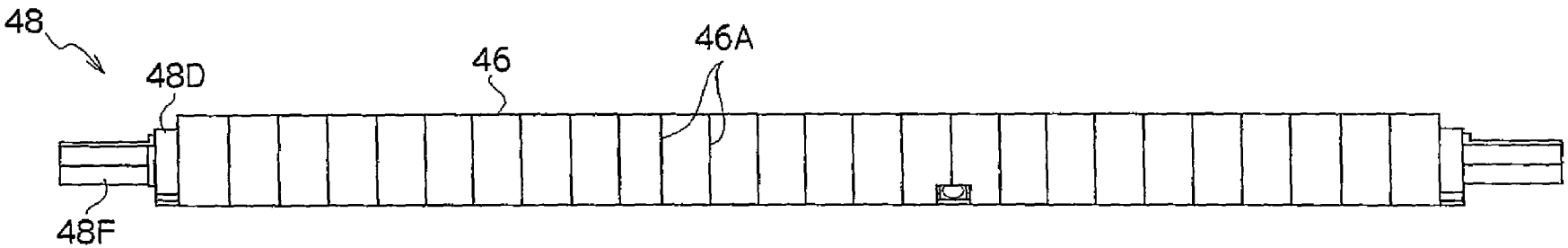
Figure 9:
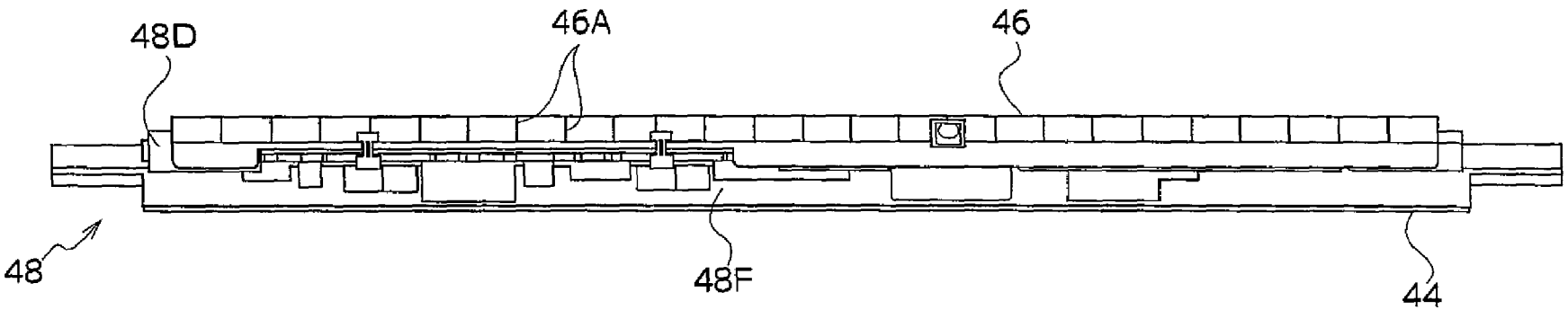
FIG. 9 is a schematic structural view illustrating a heat generation controlling member in the fixing device according to still another embodiment of the present invention, in which the heat generation controlling member is provided with slits.

For example, slits can be provided on a surface of the heat generation controlling member as are shown in FIGS. 8 and 9 so that paths of the eddy current are shielded. The slit 46A can be formed by providing one or more grooves along the width direction of the heat generation controlling member 46 (namely, along the circumferential direction of the fixing belt 38). The slit 46A may be formed as plural grooves arranged with a certain space between each other. Alternatively, the one or more grooves of the slit 46A can be provided with an inclined direction relative to the width direction of the heat generation controlling member 46. By forming the slit 46A, heat migration (heat conduction) in the axis direction of the heat generation controlling member 46 (rotational axis direction of the fixing belt 38) can be controlled. As a result, when the temperature of regions other than the paper-passing region in the fixing belt 38 begins to rise due to continuously passing paper having a small size, heat is transferred from the raised temperature regions of the regions other than the paper-passing region to the facing heat generation controlling member 46. Due to reduction of the saturation magnetic flux density in the heat generation controlling member 46 accompanying the temperature rise, heat generation at the heat generation layer in the regions other than the paper-passing region of the fixing belt begins to be controlled. Moreover, when the temperature rises to the vicinity of the Curie temperature of the temperature-sensitive magnetic material contained in the heat generation controlling member 46, since the heat generation controlling member changes from being magnetic to being non-magnetic, the heat generation at the heat generation layer is further controlled. At this time, when the heat of a high temperature portion of the regions other than the paper-passing region in the heat generation controlling member 46 migrates to a low temperature portion in the axis direction, since the temperature of those regions other than the paper-passing region is lowered and control of the heat generation at the heat generation layer ceases to be possible, as a result, the effect of controlling the temperature rise of the regions other than the paper-passing region of the fixing belt is reduced. The provision of the above-mentioned slits is preferable from the standpoint that this heat migration in the axis direction can be prevented.

FIG. 8 is a schematic structural (plain) view illustrating a heat generation controlling member in the fixing device according to another embodiment of the present invention, in which the heat generation controlling member is provided with slits. FIG. 9 is a schematic structural (side) view illustrating a heat generation controlling member in the fixing device according to still another embodiment of the present invention, in which the heat generation controlling member is provided with slits.

The temperature-sensitive magnetic materials can be largely classified into metal materials or oxide materials. The oxide materials (such as ferrite) may have problems such as: difficulties in making thin (approximately 300 μm or less) and readiness crack, which makes handling difficult; having a low thermal conductivity due to a large heat capacity, which prevents the oxide material from sensitively following temperature variations of the fixing belt, resulting in failure to carry out the aim of controlling the heat generation of the heat generation controlling member 46.

In view of removing the above problems, the heat generation controlling member uses a metal material which is inexpensive, can easily be molded into a thin form, and has good workability, flexibility and a high thermal conductivity as the temperature-sensitive magnetic metal material. Preferable examples of the metal material include a metal alloy material such as that including at least one of Fe, Ni, Si, B, Nb, Cu, Zr, Co, Cr, Mo, V, Mn and the like, and specific examples thereof include a binary magnetism-adjusted steel made of Fe and Ni and a ternary magnetism-adjusted steel made of Fe, Ni and Cr.

The temperature-sensitive magnetic material is a ferromagnetic material, and when the temperature thereof rises near the Curie temperature of this material, the material is non-magnetized (paramagnetized). When a ferromagnetic material having a relative magnetic permeability of several hundreds or more is non-magnetized (i.e., gets into a paramagnetic or diamagnetic state), the relative magnetic permeability gets close to 1 so that the magnetic flux density changes (i.e., the magnetic field becomes strong or weak). Thus, by the non-magnetization of the temperature-sensitive magnetic material, the magnetic flux density thereof is made weak so that this material can be changed into a material which hardly generates heat.

The depth of an outer cover of any electric conductor made of metal is generally represented by the following Equation (1). When the depth of an outer cover of a conductor is set to the thickness of the temperature-sensitive magnetic metal layer or less, the conductor is thermally treated, thereby making the magnetic permeability thereof high, or the frequency of the magnetic field generating device 42 is made high. Alternatively, the setting can be realized by selecting a material having a small intrinsic resistivity value. In the present exemplary embodiment, it is no essential that the depth of an outer cover of a conductor is substantially equal to or less than the thickness of the temperature-sensitive magnetic metal layer. It is, however, desirable to set the depth of an outer cover of a conductor to the thickness of the temperature-sensitive magnetic metal layer or less, since the advantageous effect is increased. In this case, the relative magnetic permeability of the temperature-sensitive magnetic material is selected according to the Equation (1) accounting for the thickness of the heat generation controlling member 46 when the heat generation controlling member 46 is subjected to a temperature of substantially less than the Curie temperature. For example, when the temperature-sensitive magnetic material is a magnetic alloy of Fe—Ni and the thickness of the heat generation controlling member 46 is about 50 μm, the relative magnetic permeability of the temperature-sensitive magnetic material is selected to be at least approximately 5,000.

$$\delta = 503\sqrt{\frac{\rho}{f \cdot \mu_r}} \qquad \text{Equation 1}$$

In Equation (1), δ represents a "skin depth", which is the depth of an outer cover of the conductor (m), ρ represents the intrinsic resistivity value (Ωm), f represents the frequency (Hz), and μ represents the relative magnetic permeability.

Examples of a shape of the heat generation controlling member 46 include a shape obtained by cutting a portion that has a thickness (for instance, equal to or approximately 20 to equal to or approximately 300 μm) and corresponds to a range of a prescribed central angle of a cylinder (for instance, substantially in the range of equal to or approximately 30° to equal to or approximately 180°), while the scope of the shape of the heat generation controlling member 46 is not limited thereto.

The following will describe the fastening member 44 hereinafter. The fastening member 44 is, for example, a rod-shaped member having an axial line in the axial direction (the width direction) of the fixing belt 38. The fastening member 44 is a member for resisting pressing force acting from the pressing roll 40. When the pressing roll 40 is pressed across the fixing belt 38 against the fastening member 44, the fixing belt 38 is deformed toward the side of the inner circumferential face thereof. When a curvature is given to the fixing belt 38 at the downstream side of the contact region in the pressing roll 40 and the fastening member 44 along the carrier direction of the sheet as described above, the sheet is peeled from the fixing belt.

In order to obtain the peelablity of the sheet, the fixing belt is selected with a consideration of "whether or not the fixing belt 38 can be deformed toward the side of the inner circumferential face thereof when the pressing roll 40 is pressed across the fixing belt 38 against the fastening member 44". However, in the fixing belt 38 in the present exemplary embodiment, the metal material is used; therefore, the flexibility is decided by the metal layer for deciding the rigidity of the fixing belt 38, that is, the thickness of the temperature-sensitive magnetic metal layer.

It can be examined, by use of a hard material of a non-magnetic stainless steel, whether or not the fixing belt 38 warps or bends toward the inside thereof inside its elastic deformation region. When a pressing force equal to or more than the load imposed onto the fixing belt at least at the time of the fixation of an image is given thereto, the warp amount thereof is evaluated. As a result, when the thickness of the hard material is about 250 μm, the material hardly warps. When the thickness is about 200 μm, the generation of a slight warp begins. When the thickness is about 150 μm, about 125 μm, about 100 μm, and about 75 μm, a sufficient warp is generated. Accordingly, the metal material layer of the fixing belt 38 is desirably equal to or approximately 200 μm or less.

Particularly preferable examples of the material of the fastening member 44 include a heat resistant resin and a heat resistant rubber. Examples of the material of the fastening member 44 include a heat resistant resin such as glass fiber reinforced PPS (polyphenylenesulfide), phenol, polyimide, or a liquid crystal polymer. Besides these materials, preferable examples thereof further include aluminum in terms of being a metal having a high heat conductivity.

In the next place, the supporting member 48 will be described. Examples of a configuration of the supporting member 48 include that having a supporting member 48A, a spring member 48B for supporting the heat generation controlling member 46 and a shaft 48C disposed at both ends in a longer direction of the supporting member 48A.

A material to form the supporting member 48A and the shaft 48C is not particularly limited as long as the material gives a warp amount in an allowable level range or less (specifically, for example, a warp amount of equal to or approximately 0.5 mm or less) when the material receives pressing force from the pressing roll 40, and examples thereof include a metal material and a resin material. Furthermore, the supporting member 48A is formed of a non-magnetic metal material (namely, a non-magnetic metal member such as copper, aluminum, silver or a non-magnetic stainless).

In the case that the shafts are largely warped by load imposed onto the shafts so that a problem is caused about the rigidity of the shafts, the supporting member may be a structural body having of a member made of a material having such a Young's modulus that a small warp is given and a nonmagnetic metal. In this case, the thickness of the nonmagnetic layer can be made approximately equal to or more than the depth of the outer cover represented by Equation (1).

In the case that the supporting member 48A is formed of a magnetic metal material, a side of the supporting member 48A which faces the magnetic field generating device 42 can be shielded with a member formed of a non-magnetic metal material having a low resistivity (such as copper, aluminum or silver) and having an approximately equal to or larger than the depth of the outer cover so that magnetic flux from the magnetic field generating device 42 does not reach the magnetic metal material. If magnetic flux from the magnetic field generating device 42 reaches the magnetic metal material, energy is ineffectively wasted due to an increase in Joule heat generation caused by eddy current.

On the other hand, the spring member 48B is a joining member to connect the heat generation controlling member 46 and the supporting member 48A and directly supports the heat generation controlling member 46. The spring member 48B connects the heat generation controlling member 46 at both ends in a width direction thereof.

Furthermore, the spring member 48B can be formed by, for example, a curved plate spring (such as a plate spring made of metal or a plate spring made of one or more of various kinds of elastomers). The heat generation controlling member 46 is supported by the spring member 48B and, even when the fixing belt 38 rotates eccentrically and thereby the fixing belt 38 is displaced in a radial direction, follows the displacement to maintain a contact state with an inner peripheral surface of the fixing belt 38.

The heat generation controlling member 46 may further function as the spring member 48B. In such a case, a configuration in which the heat generation controlling member and the spring member are integrated with each other can be formed.

The following will describe the driving force transmitting members 50. The driving force transmitting members 50 are each a member for transmitting driving force for rotating the fixing belt 38 around its rotary center. The members 50 are each composed of, for example, a flange section 50A fitted to the inside of one of ends of the fixing belt 38 and a cylindrical gear section 50B having, in its outer circumferential face, irregularities. The driving force transmitting members 50 are made of, for example, a metal material, or a resin material.

The driving force transmitting members 50 are supported by the ends of the fixing belt 38 by inserting the flange sections 50A to the insides of the ends of the fixing belt 38. The gear sections 50B of the driving force transmitting members 50 are driven to be rotated by a motor or the like, which is not illustrated in Figures. Furthermore, the rotary driving force is transmitted to the fixing belt 38 so that the belt 38 is rotated around its rotary center.

While the driving force transmitting members 50 are provided on both the ends of the fixing belt 38 in its axial direction in the present exemplary embodiment, the invention is not limited to this. A driving force transmitting member may be provided on only one end of the fixing belt 38 in its axial direction. While the driving force transmitting members 50 are supported at the ends of the fixing belt 38 by fitting the flange sections 50A to the insides of the ends of the fixing belt 38 in the present exemplary embodiment, the invention is not limited to this. The driving force transmitting members 50 may be supported at the ends of the fixing belt 38 by providing ends of the fixing belt 38 on the insides of the flange sections 50A.

The following will describe the magnetic field generating device 42 hereinafter. The magnetic field generating device 42 is formed to have a shape following the outer circumferential face of the fixing belt 38. The device 42 is arranged oppositely to a heat generation controlling member 46 to interpose the fixing belt 38 between the device 42 and the member 46, and separately from the outer circumferential face of the fixing belt 38 to have an interval of, e.g., equal to or approximately 1 to equal to or approximately 3 mm. In the magnetic field generating device 42, an exciting coil (magnetic field generating unit) 42A wound into plural circles is arranged along the axial direction of the fixing belt 38.

An exciting circuit (not illustrated in Figures) for supplying an alternating current to the exciting coil 42A is connected to the exciting coil 42A. Moreover, a magnetic substance member 42B is arranged to extend along the length direction of the exciting coil 42A (the axial direction of the fixing belt 38) on the surface of the exciting coil 42A. By interposing the exciting coil 42A and the fixing belt 38 between the magnetic substance member 42B and the heat generation controlling member 46 which is the magnetic substance, a magnetic path is formed, and control of magnetic field leakage, improvement of magnetic coupling, and improvement of a power factor can be achieved. It is preferable that the magnetic substance member 42B is a ferromagnetic substance. Examples of the ferromagnetic substance include ferromagnetic metal materials such as iron, nickel, chrome and manganese, alloys thereof, oxides thereof and the like. The ferromagnetic substance can be selected so that eddy current loss and hysteresis loss becomes small. In a case where eddy current loss is large, slit(s) or cut(s) may be formed in the heat generation controlling member 46, or the heat generation controlling member 46 may be configured so as to be laminated in a thin plate shape such as a silicon steel plate, so as to make flowing of the eddy current more difficult.

Examples of materials having small eddy current loss and hysteresis loss include soft ferrite, soft magnetic metal materials being oxides, and the like.

An output of a magnetic field generating device 42 is applied in a range where for instance magnetic flux (magnetic field) penetrates through a heat generating layer of the fixing belt 38 to generate heat and, at a temperature less than the Curie temperature, the magnetic flux (magnetic field) does not readily penetrate through the heat generation controlling member 46 and heat is not generated.

The magnetic field generating device 42 is provided at the side of the inner circumferential face of the fixing belt 38 to have a predetermined interval from the face. In such a case, the heat generation controlling member 46 is provided so as to be in contact with the outer circumferential face of the fixing belt 38.

The following will describe the operation of the image forming device 100 according to the present exemplary embodiment.

First, the surface of the photoreceptor drum 10 is charged by the charging device 12. Next, from the exposure device 14, the light L is imagewise radiated to the surface of the photoreceptor drum 10 so that a latent image is formed on the surface by a difference between electrostatic potentials on the surface. The photoreceptor drum 10 is rotated in the direction of the arrow A so that the latent image is shifted to a position opposite to one (the unit 16A) out of the developing units of the developing device 16. A first color toner is then shifted from the developing unit 16A onto the latent image so that a toner image is formed on the surface of the photoreceptor drum 10. By the rotation of the photoreceptor drum 10 in the direction of the arrow A, this toner image is transported to a position opposite to the intermediate transferring body 18, and then the image is electrostatically transferred primarily onto the surface of the intermediate transferring body 18 by the transferring device 24.

After the primary transfer, the toner remaining on the surface of the photoreceptor drum 10 is removed by the cleaning device 20. The surface of the photoreceptor drum 10 subjected to the cleaning is potentially initialized by the discharging exposure device 22, and again shifted to the position opposite to the charging device 12.

Thereafter, three (the units 16B, 16C and 16D) out of the developing units of the developing device 16 are successively shifted to the position opposite to the photoreceptor drum 10. Second, third and fourth color toner images are successively formed in the same manner, so that the four color toner images are overlapped (unified). The overlapped (unified) toner images are transferred onto the surface of the intermediate transferring body 18 at one time.

The toner images unified on the intermediate transferring body 18 are carried onto a position where the transferring roll 30 and the transferring opposite roll 28 face each other by a rotary shift of the intermediate transferring body 18 in the direction of the arrow B, so that the toner images are brought into contact with the fed recording paper P. A transferring bias voltage is being applied to the transferring roll 30 and the intermediate transferring body 18 across these members 30 and 18, so that the toner images are transferred secondarily onto the surface of the recording paper P.

The recording paper P holding the toner images, which have not yet been fixed, is carried to the fixing device 32 via a paper-carrying guidance member 36.

The following will describe the action of the fixing device 32 according to the present exemplary embodiment hereinafter.

For example, at the same time (hereinafter it should be naturally understood that the expression "at the same time" cannot be deemed as necessary requiring that the two actions are strictly simultaneously carried out: a certain time lag between the two actions is allowed as a matter off course) when the toner image forming action is started in the image forming device 100, the following action is first carried out in the fixing device 32: in the state that the fixing belt 38 and the pressing roll 40 are separated from each other (see FIG. 4), the driving force transmitting member 50 is driven by the motor (not illustrated), so as to be rotated, and the fixing belt 38 is driven to be rotated accordingly in the direction of the arrow D at a circumferential speed of, e.g., equal to or approximately 200 mm/sec.

Figure 5B:
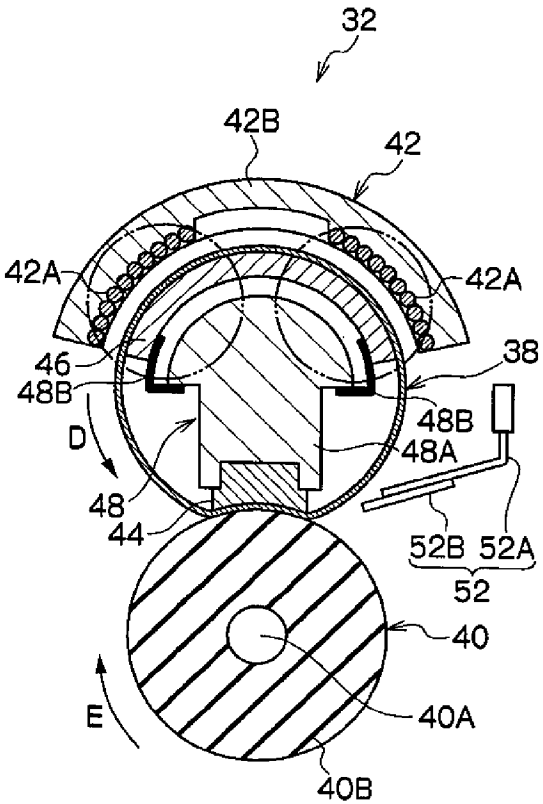
FIG. 5B is a schematic sectional view schematically illustrating main magnetic fluxes which penetrate the fixing belt in the fixing device according to the embodiment of the present invention.
Figure 5A:
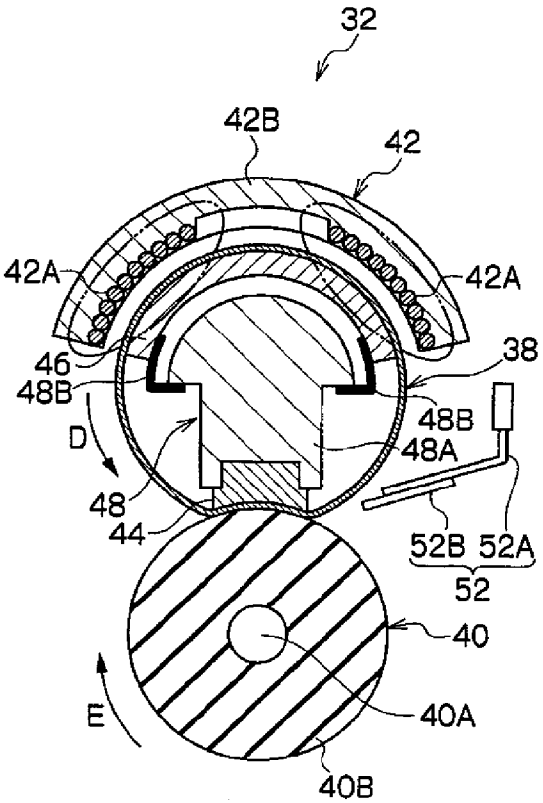
FIG. 5A is a schematic sectional view schematically illustrating main magnetic fluxes which penetrate the fixing belt in the fixing device according to the embodiment of the present invention.

Together with the rotary driving of the fixing belt 38, an alternating current is supplied from the exciting circuit (not illustrated) to the exciting coil 42A included in the magnetic field generating device 42. When the alternating current is supplied to the exciting coil 42A, magnetic fluxes are generated or extinguished around the exciting coil 42A. The generation and the extinction are repeated. When the magnetic fluxes (the magnetic field) cross the heat generating layer 38A of the fixing belt 38, an eddy current is generated in the heat generating layer to generate a magnetic field for inhibiting the change in the former magnetic field. As a result, heat is generated in proportion to the skin resistance of the heat generating layer 38A and the square of the current flowing into the heat generating layer 38A (see FIG. 5A). In FIGS. 5A and 5B, the alternate long and two short dashes lines each indicate main magnetic fluxes.

By this heat generated in the heat generating layer 38A, the fixing belt 38 is heated to the setup temperature (for example, 150° C.) in, for example, about 10 seconds.

Next, in the state that the pressing roll 40 is pressed against the fixing belt 38, the recording paper P fed to the fixing device is sent into the contact region between the fixing belt 38 and the pressing roll 40, and then heated and pressed by means of the fixing belt 38 heated by the heat generator and the pressing roll 40 to melt the toner image and compress the image onto the surface of the recording paper P. As a result, the toner image is fixed on the surface of the recording paper P.

When images are continuously fixed on recording papers P each having a smaller size than the fixing region width (i.e., the length in the axial direction) of the fixing belt 38 in image-fixation by the fixing belt 38 and the pressing roll 40, heat is consumed in a paper-passing region in the fixing belt 38 while heat is not consumed in regions other than the paper-passing region. For this reason, temperature rises in the regions other than the paper-passing region in the fixing belt 38.

When the temperature of the regions other than the paper-passing region in the fixing belt 38 gets close to the Curie temperature of the temperature-sensitive magnetic material which constitutes the heat generation controlling member 46, a region in the heat generation controlling member 46 which overlaps (contacts) on the regions other than the paper-passing region in the fixing belt 38 is non-magnetized. In this way, a difference in magnetic fluxes (i.e., strength and weakness of the magnetic field) is generated between the paper-passing region, where magnetism is maintained, and the regions other than the paper-passing region, which are being non-magnetized (i.e., is in a paramagnetic state). As a result, in the heat generating layer, heat is less generated in the regions other than the paper-passing region than in the paper-passing region. In this way, the generation of heat in the heat generating layer of the fixing belt 38 is controlled by the heat generation controlling member 46.

As is understood from Equation (1), when the heat generation controlling member 46 is non-magnetized (i.e., the relative magnetic permeability thereof gets close to one), the magnetic fluxes (the magnetic field) penetrate it with ease. As illustrated in FIG. 5B, in the case that at this time the supporting member 48A is present which is made of a nonmagnetic metal material having a low intrinsic resistivity value (such as silver, copper or aluminum) (i.e., which has a larger thickness than the depth of the outer cover), the magnetic fluxes (the magnetic field) flow mainly as an eddy current into the supporting member 48A so as to restrain further heat generated by loss based on an eddy current flowing in the heat generating layer of the fixing belt 38. The magnetic fluxes (the magnetic field) penetrating the heat generation controlling member 46 reach the supporting member 48A, which is made of a nomnagnetic metal material, so as to return to the magnetic field generating device 42. Additionally, the supporting member 48A is arranged neither to contact the fixing belt 38 nor the heat generation controlling member 46 so that the supporting member 48A does not take thermal energy away from the fixing belt 38.

Figure 7:
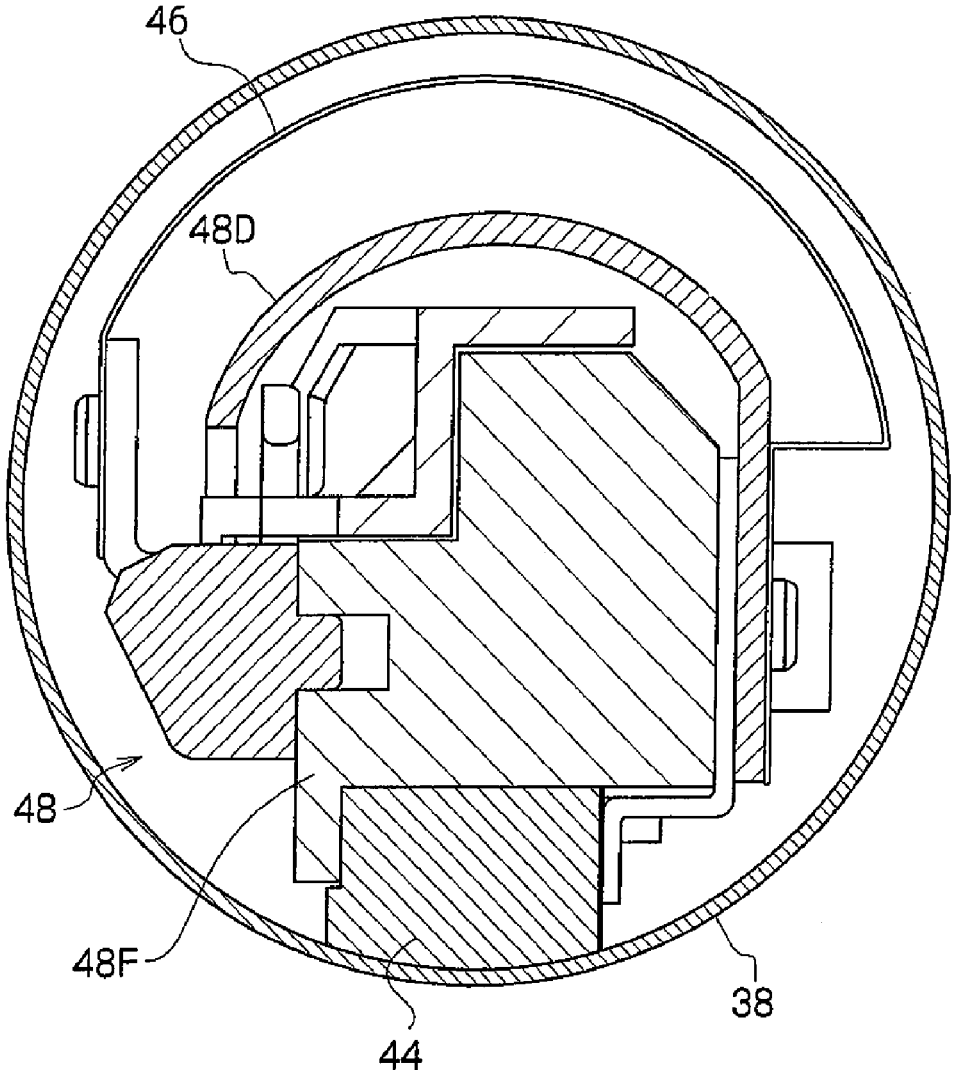
FIG. 7 is a schematic sectional view illustrating a heat generation controlling member and supporting member in the fixing device according to still another embodiment of the present invention.

The supporting member 48A may be configured by a non-magnetic metallic inducing member 48D comprising a metal having a low intrinsic resistivity such as aluminum, copper or silver, and a structure of a support 48F. Examples of such a configuration include that shown in FIG. 7, in which a curved plate-shaped non-magnetic metallic inducing member 48D is provided between the heat generation controlling member 46 and the supporting member 48A. Here, as described above, the non-magnetic metallic inducing member 48D having a low intrinsic resistivity is a member for controlling heat generation due to eddy current loss flowing in the heat generation layer of the fixing belt 38. The support 48F is a member for supporting a load from the pressing roll 40 and preferably has rigidity with little flexibility. Further, when the non-magnetic metallic inducing member 48D is contacted with the fixing belt 38 and also the heat generation controlling member 46, the main subject of heat migration between the fixing belt 38 and the non-magnetic metallic inducing member 48D is heat conduction via the heat generation controlling member 46, and the heat migration amount per unit of time becomes large. As a result, since the heat migration amount per unit of time in the axis direction becomes large, an effect of controlling the temperature rise is obtained by dispersing the temperature rise in the regions other than the paper-passing region of the fixing belt 38 itself, in the axis direction. Herein, FIG. 7 is a schematic sectional view illustrating a heat generation controlling member and supporting member in the fixing device according to still another embodiment of the present invention.

On the other hand, when the fixing belt 38 and the pressing roll 40 conduct fixing, the fixing belt 38 rotates while being supported by and brought into contact without pressing force with the heat generation controlling member 46 having a shape that is similar to the shape of the inner periphery surface of the fixing belt 38 and, while suppressing the sliding resistance, suppresses any residual vibrations from the fastening member of the fixing belt, and receives an electromagnetic force (a repulsion force between a magnetic field from a coil, and a counteractive magnetic field that acts in the direction against the magnetic field of eddy currents flowing in the heat generating layer, that is, a force in a direction diverging from the coil is applied to the belt). Thereby, while maintaining a stable distance between the belt and the coil, the fixing is carried out with the belt shape maintained.

When the recording paper P is fed out from the contact region between the fixing belt 38 and the pressing roll 40, the paper P is likely to be brought to straightly advance in the direction along which the paper P is fed out by the rigidity thereof. The front end of the paper P is then peeled from the fixing belt 38 deformed to the side of its inner circumferential face so as to be wound. The peeling member 52 (the peelable sheet 52B) is then put into a gap between the front end of the recording paper P and the fixing belt 38, so that the recording paper P is peeled from the surface of the fixing belt 38.

As described above, the toner image is formed on the recording paper P and then fixed thereon.

Figure 6:
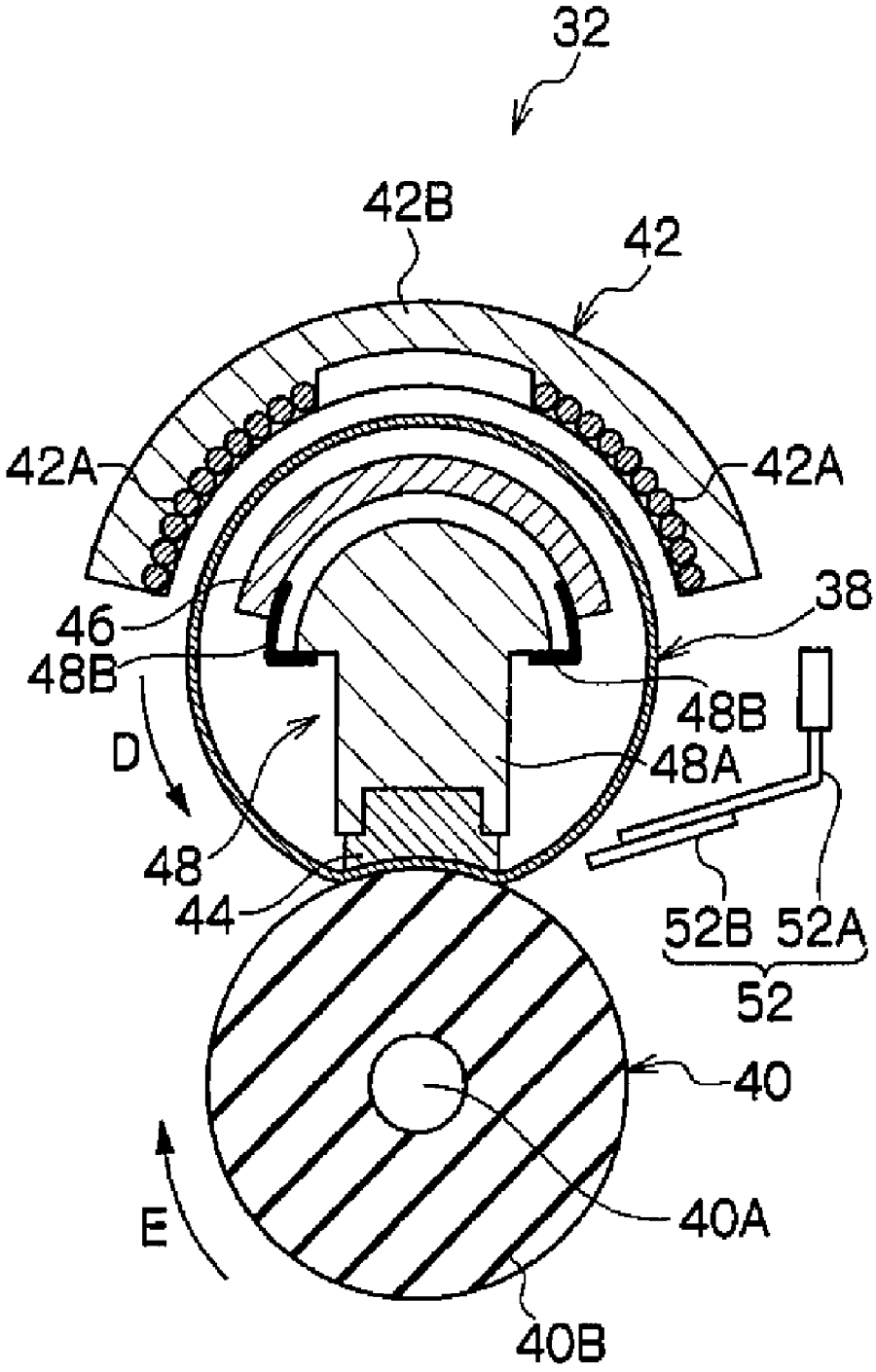
FIG. 6 is a schematic structural view illustrating an image forming device according to another embodiment of the present invention.

In the present exemplary embodiment, the fixing belt 38 that rotates and is brought into contact without a pressing force with and is supported by the heat generation controlling member 46 having a shape similar to the shape of the inner periphery surface thereof is shown. However, the scope of the configuration of the present is not limited thereto. Examples of the invention further include an embodiment in which a fixing belt 38 and a heat generation controlling member are disposed so as not to come into contact with each other, as shown in FIG. 6. Such an embodiment has a configuration in which the transfer of heat energy of the fixing belt 38 to the heat generation controlling member 46 is prevented.

EXAMPLES

The following will describe a test example of the above-described exemplary embodiment of a fixing device according to the present invention.

Test Example 1

First, the fixing device (see FIGS. 1, 2 and 6) according to the above-described embodiment is used to conduct an evaluation described below. Members used in the device are as follows.

- Fixing belt: a belt which is formed by, onto an outer circumferential face of a polyimide resin substrate having a diameter of 30 mm, a width of 370 mm and a thickness of 60 μm, laminating a copper layer (heat generating layer) having a thickness of 10 μm and a PFA layer (PFA: copolymer of tetrafluoroethylene and perfluoroalkyl vinyl ether) having a thickness of 30 μm successively, and has a heat resistant temperature of approximately 240° C.
- Pressing roll: a roll which has an outer diameter of 28 mm and a length of 355 mm and is formed by laminating a sponge elastic layer having a thickness of 5 mm and a PFA layer having a thickness of 30 μm as a surface releasing layer successively onto a core metal axis which has a diameter of 18 mm and is made of stainless steel.
- Heat generation controlling member: a heat generation controlling member is a curved plate having a shape obtained by cutting out a portion corresponding to a center angle of 160° of a cylinder having a thickness of 150 μm, a length of 340 mm and a diameter of 30 mm, the curved plate being constituted of a Fe—Ni alloy (trade name: MS-220, manufactured by NEOMAX Materials Co., Ltd.) that has the maximum relative magnetic permeability of 10,000 or more (as-processed hard material that has the relative magnetic permeability of substantially 400 is heat-treated by annealing to provide a soft material having high permeability) and a Curie temperature of being in a range of 215° C. to 230° C.
- Distance between the fixing belt and the heat generation controlling member: although the fixing belt and the heat generation controlling member are contacted with each other in the configuration in FIG. 2, the heat generation controlling member is disposed so as to not be in contact with the fixing belt in the configuration in FIG. 6. In the configuration in FIG. 6, the heat generation controlling member is disposed so that a distance between the fixing belt and the heat generation controlling member is approximately 1 mm. An arc which corresponds to an angle of 160° for a circle with a radius of 14 mm is made to be in non-contact along the fixing belt so as to be substantially concentric therewith. In the case of the configuration in FIG. 6, since the initialization preparation can be completed in an extremely short time with a warm up time (start up time) of 6 to 8 sec in the present test example, the power may be turned on only at the time of use, and an extremely energy efficient fixing device can be provided. On the other hand, 11 to 13 sec is required for the warm up time in the configuration in FIG. 2.

Supporting member: a supporting member made of aluminum, which is a non-magnetic metal.

Evaluation

In each of the structures shown in FIG. 2 and FIG. 6, The power of the magnetic field generating device is controlled to be in the range of 400 to 1100 W. Under that conditions that the setup temperature is from 160 to 170° C. and the process speed is 170 mm/s, recording papers (trade name: JD PAPER, manufactured by Fuji Xerox Co., Ltd., and each having a size B5, weight per unit area: 98 g/m$^2$) are used. The papers are each fed into the device so as to direct one out of short sides thereof ahead. Image fixation is continuously carried out onto the papers, the number of which is 1,000. The temperature of the paper-passing region in the fixing belt and that of regions other than the paper-passing region are then each measured.

As a result, the temperature of the paper-passing region in the fixing belt is from 160 to 170° C. while that of the regions other than the paper-passing region is controlled into 230° C. or less.

Comparative Example 1

Comparative Example 1 is prepared in the same manner as the Test example 1 except that the heat generation controlling member is not provided thereto. Comparative Example 1 is then subjected to the same evaluation as that for the Test Example 1.

As a result, before image fixation is continuously carried out onto the same papers as described above, the number of which is 100, the temperature of the regions other than the paper-passing region exceeds 235° C., which is the heat resistant temperature of the fixing belt.

Next, a heat pipe having a diameter of 12.7 mm is provided, as a temperature uniformalizing unit for restraining a rise in the temperature of the regions other than the paper-passing region, so that the heat pipe contacts the pressing roll. The thus-modified fixing device of Comparative example 1 is subjected to the same evaluation as described above. As a result, when image fixation is continuously carried out onto the same papers the number of which is from about 300 to 400, the temperature of the regions other than the paper-passing region reaches 235° C., which is the heat resistant temperature of the fixing belt.

It is understood from the above results that even if recording media having various sizes various, such as those having a small size, are used in the test example of the present invention, a rise in the temperature of regions other than a paper-passing region in a fixing belt is made lower so as to prevent overheating further than in the comparative example.

What is claimed is:

1. A fixing device comprising:

a first rotary body, the first rotary body being a belt, having a heat generating layer from which heat is generated by action of a magnetic field and formed in a substantially circular cylindrical shape, a thermal capacity of the first rotary body is in the range of from equal to or approximately 5 J/K to equal to or approximately 60 J/K;

a second rotary body contacting the first rotary body;

a magnetic field generating unit for generating a magnetic field, the magnetic field generating unit being arranged to have a predetermined separation from the inner circumferential face of the first rotary body or to have a predetermined separation from the outer circumferential face of the first rotary body; and a heat generation controlling member which is arranged facing the magnetic field generating unit, with the first rotary body being between the heat generation controlling member and the magnetic field generating unit, the heat generation controlling member comprising a temperature-sensitive magnetic material which is a non-heat generating body having a Curie temperature and controlling generation of heat of the heat generating layer.

2. The fixing device according to claim 1, wherein the Curie temperature is substantially equal to or higher than a setup temperature of the first rotary body, and the Curie temperature is substantially equal to or lower than the heat resistant temperature of the first rotary body.

3. The fixing device according to claim 1, further comprising a nonmagnetic metal member, wherein the nonmagnetic metal member comprises a nonmagnetic metal material, is arranged inside the first rotary body, and faces the magnetic field generating unit, with the first rotary body and the heat generation controlling member being between the nonmagnetic metal member and the magnetic field generating unit so that the nonmagnetic metal member does not contact the heat generation controlling member.

4. The fixing device according to claim 1, further comprising a nonmagnetic metal member, wherein the nonmagnetic metal member comprises a nonmagnetic metal material, is arranged inside the first rotary body, and faces the magnetic field generating unit, with the first rotary body and the heat generation controlling member being between the nonmagnetic metal member and the magnetic field generating unit so that the nonmagnetic metal member contacts the heat generation controlling member and the heat generation controlling member contacts the first rotary body.

5. The fixing device according to claim 1, wherein the heat generating layer comprises a non-magnetic metal.

6. The fixing device according to claim 1, further comprising a shielding unit which shields an eddy current generated in the heat generation controlling member due to electromagnetic induction from the magnetic field generating unit.

7. The fixing device according to claim 6, wherein a slit or a cut, each of which is formed in the heat generation controlling member, functions as the shielding unit.

8. The fixing device according to claim 1, further comprising a driving force transmitting member for transmitting rotary driving force to the first rotary body, the driving force transmitting member being disposed at least one of the two ends of the first rotary body along the direction of the axis of the first rotary body.

9. The fixing device according to claim 1, wherein the heat generation controlling member contacts the first rotary body.

10. The fixing device according to claim 1, wherein the heat generation controlling member is disposed so as to be in contact with the first rotary body without applying a pressing force.

11. The fixing device according to claim 1, wherein the heat generation controlling member does not contact the first rotary body.

12. The fixing device according to claim 1, wherein the heat generation controlling member is a non-heat generating body.

13. The fixing device according to claim 1, wherein the temperature-sensitive magnetic material is a metallic material.

14. The fixing device according to claim 1, wherein, when the first rotary body contacts the second rotary body, the contact portion of the first rotary body with the second rotary body is elastically deformed toward the inside circumferential face of the first rotary body.

15. An image forming device comprising:

a latent image holding body;

a latent image forming unit for forming a latent image on a surface of the latent image holding body;

a developing unit for developing the latent image into an image with an electrophotographic developer;

a transferring unit for transferring the developed image onto a transfer-receiving medium; and a fixing device of claim 1 for fixing the image on the transfer-receiving medium.

16. The image forming device according to claim 15, wherein the first rotary body rotates while being supported by and brought into contact without pressing force with the heat generating controlling member; or the first rotary body and the heat generation controlling member are disposed so as not to come into contact with each other.

17. The fixing device according to claim 1, wherein the first rotary body rotates while being supported by and brought into contact without pressing force with the heat generating controlling member; or the first rotary body and the heat generation controlling member are disposed so as not to come into contact with each other.

18. The fixing device according to claim 1, wherein heat generated by the heat controlling member due to action of a magnetic field applied to the heat generating layer is smaller than heat generated by the heat generating layer due to action of the magnetic field.

19. The fixing device according to claim 1, further comprising a spring member and a supporting member formed of a magnetic metal material, and the heat generation controlling member being disposed to be in contact with an inner periphery surface of the belt without applying a substantial pressing force thereto, while maintaining the belt in a circular cylindrical shape without being in contact with the supporting member by use of the spring member.

* * * * *